US009194159B2

(12) United States Patent
Garthe

(10) Patent No.: US 9,194,159 B2
(45) Date of Patent: Nov. 24, 2015

(54) PADLOCK

(71) Applicant: ABUS August Bremicker Söhne KG, Wetter-Volmarstein (DE)

(72) Inventor: Bernhard Garthe, Gevelsberg (DE)

(73) Assignee: ABUS August Bremicker Söhne KG, Wetter-Volmarstein (DE)

( * ) Notice: Subject to any disclaimer, the term of this patent is extended or adjusted under 35 U.S.C. 154(b) by 0 days.

(21) Appl. No.: 13/914,715

(22) Filed: Jun. 11, 2013

(65) Prior Publication Data

US 2014/0360234 A1 Dec. 11, 2014

(51) Int. Cl.

| | |
|---|---|
| ***E05B 67/38*** | (2006.01) |
| ***E05B 67/18*** | (2006.01) |
| ***E05B 67/02*** | (2006.01) |
| ***E05B 67/24*** | (2006.01) |

(52) U.S. Cl.

CPC ..... *E05B 67/18* (2013.01); *E05B 67/02* (2013.01); *E05B 67/24* (2013.01); *Y10T 29/49716* (2015.01); *Y10T 70/465* (2015.04); *Y10T 70/489* (2015.04)

(58) Field of Classification Search

CPC ..... E05B 67/18; E05B 67/02; E05B 67/04; E05B 2067/025; E05B 67/24; Y10T 70/465; Y10T 70/489; Y10T 29/49716

USPC ..... 70/20, 21, 417, DIG. 43, DIG. 56, 70/DIG. 71, 50–56, 38 R, 39, 38 A, 38 B, 70/38 C, 423, 424, 427, 428, 455

See application file for complete search history.

(56) References Cited

U.S. PATENT DOCUMENTS

| | | | | | |
|---|---|---|---|---|---|
| 2,995,025 | A | * | 8/1961 | Toepfer | 70/58 |
| 3,171,908 | A | | 3/1965 | Malota | |
| 3,533,253 | A | * | 10/1970 | Paul et al. | 70/25 |
| 3,667,259 | A | | 6/1972 | Reque et al. | |
| 3,751,948 | A | * | 8/1973 | Klein | 70/55 |
| 3,882,699 | A | * | 5/1975 | Flack et al. | 70/38 A |
| 4,085,600 | A | * | 4/1978 | Bindari | 70/39 |
| 4,102,162 | A | * | 7/1978 | Miller | 70/52 |
| 4,300,370 | A | * | 11/1981 | Kaiser et al. | 70/54 |
| 4,689,975 | A | * | 9/1987 | Dunphy et al. | 70/56 |
| 4,776,187 | A | * | 10/1988 | Evans et al. | 70/38 A |
| 4,882,918 | A | * | 11/1989 | Stanich | 70/54 |
| 5,107,690 | A | * | 4/1992 | Phillips | 70/63 |
| 5,146,771 | A | * | 9/1992 | Loughlin | 70/56 |
| 5,365,757 | A | | 11/1994 | Primeau | |
| 5,449,867 | A | | 9/1995 | Kelaita, Jr. et al. | |
| 5,467,620 | A | * | 11/1995 | Byrd, Jr. | 70/38 A |
| 5,755,121 | A | | 5/1998 | Crass | |
| 6,305,198 | B1 | | 10/2001 | Chastain et al. | |
| 6,374,646 | B1 | * | 4/2002 | Brake | 70/56 |
| 6,388,213 | B1 | | 5/2002 | Letient et al. | |
| 6,393,876 | B1 | * | 5/2002 | Matyko | 70/38 A |
| 6,396,008 | B1 | | 5/2002 | Maloney et al. | |
| 6,467,316 | B1 | * | 10/2002 | Chen | 70/56 |
| 7,140,209 | B2 | * | 11/2006 | Lai | 70/25 |
| 7,278,283 | B2 | | 10/2007 | Meckbach | |
| 7,913,526 | B2 | * | 3/2011 | Loughlin et al. | 70/56 |

(Continued)

*Primary Examiner* — Lloyd Gall

(74) *Attorney, Agent, or Firm* — Dinsmore & Shohl LLP

(57) ABSTRACT

The invention relates to a padlock in particular to a padlock for securing and monitoring a switch of an industrial plant. The invention further relates to a set of padlocks, to a padlock housing and to a method of retrofitting a padlock.

18 Claims, 3 Drawing Sheets

(56) References Cited

U.S. PATENT DOCUMENTS 8,640,513 B2 * 2/2014 Goren et al. ..... 70/279.1
8,640,514 B2 * 2/2014 Goren et al. ..... 70/280
2005/0039501 A1 * 2/2005 Yu ..... 70/29
2005/0132762 A1 * 6/2005 Yu ..... 70/25
2012/0186308 A1 7/2012 Garthe
2012/0312057 A1 * 12/2012 Tonelli ..... 70/20

* cited by examiner

PADLOCK

BACKGROUND OF THE INVENTION

The invention relates to a padlock in particular to a padlock for securing and monitoring a switch of an industrial plant. The invention further relates to a set of padlocks, to a padlock housing and to a method of retrofitting a padlock.

A particular area of application of a padlock is in the field of occupational safety. There is the risk in connection with the servicing of industrial plants, for example, of a production machine, that the industrial plant deactivated for the purpose of service work is activated again by accident while the servicing work is still continuing. A substantial danger for the service engineer can result from this. It is therefore customary that the service engineer moves a switch associated with the industrial plant to an OFF position for the duration of the service work and secures it in this position, i.e. the switch is directly blocked or access to the switch is blocked. The named switch is typically an energy supply switch, for example a main electrical switch of a control device or of an energy supply device of the industrial plant (e.g. power switchbox). Alternatively to this, the named switch can, for example, be a valve of a liquid line or of a gas line.

In order to effectively avoid an accidental activation of the industrial plant by another person, each service engineer hangs a padlock on the named switch or on a blocking device associated with the switch before starting his work and locks said padlock. The switch is hereby secured in its OFF position, i.e. the switch cannot be moved accidentally back into an ON position by another person. When the service engineer has ended his work, he unlocks his padlock again and releases it from the switch. Each service engineer usually has his own individual padlock (or a plurality of his own individual padlocks) associated with him.

This procedure is also called locking out. The padlock used is accordingly called a lockout lock. The document U.S. Pat. No. 5,449,867 shows such a securing of an electric rocker switch by means of a padlock. It is known from the document U.S. Pat. No. 3,171,908 to secure the position of a rotary switch by means of a padlock.

So that a plurality of service engineers can block and release the switch again independently of one another, a plurality of receivers (e.g. eyelets) can be provided at the switch for hanging a plurality of lockout locks. This is known from the document U.S. Pat. No. 6,388,213, for example. If only a single receiver for a lockout lock is provided, a securing claw can be used which is hung into the respective eyelet of the switch or of the associated blocking device and which in turn has a plurality of hang-in eyelets for a respective padlock. Only when the last padlock has been removed from the securing claw, the securing claw can be removed from the switch so that it can again be brought into the ON position. Such a securing claw for use at an electric switchbox is known, for example, from documents U.S. Pat. Nos. 6,396,008, 5,365,757 and 3,667,259.

It is known in connection with such a securing of a switch of an industrial plant to equip the lockout lock having a lock body used with a housing of plastic, with a shackle being displaceably held at the lock body and with a lock cylinder being arranged in the lock body. The lock cylinder can selectively be brought from an open position into a locked position to lock the shackle to the lock body after the shackle has, for example, been hung into an eyelet of the switch. By forming the lock housing from plastic, a particularly light padlock results which is of advantage in the use as a lockout lock since the service engineers occasionally carry a plurality of lockout locks simultaneously. A housing of plastic can also contribute to a desired electrical insulation. By the use of a plastic housing, there is furthermore a particularly simple possibility of color marking the padlock. Such a lockout lock having a housing of plastic is known, for example, from documents U.S. Pat. Nos. 7,278,283 and 5,755,121.

Depending on the specific application or use, a customer may desire different designs of the lockout lock. It may for example be necessary to have a relatively long lock housing so that identity pictures or photos can be applied to the lock housing and/or warning messages can be printed on the lock housing in multiple languages. Such a modification of the exterior of the lockout lock should, however, not necessarily affect its interior (i.e. the lock body, particularly the locking mechanism including for example a lock cylinder, an associated key and displaceable locking members). It is also desirable that such a change of the design may be carried out fast and easily by a locksmith or a service unit. The known padlocks, however, require an enormous investment in inventory to meet the market's expectations for fast delivery of special versions, due to the numerous possibly required versions (e.g. color, size, shackle engagement length, cylinder configuration).

SUMMARY OF THE INVENTION

It is an object of the invention to provide a padlock which enables a reliable securing of a switch of an industrial plant with a simple design, and which allows for an easy and fast change of the exterior of the padlock.

Particularly, it is an object of the invention to provide a padlock which has a relatively long housing and which can be produced by retrofitting a standard size padlock. It is another object of the invention to provide a padlock which minimizes the necessary inventory investment.

This object is satisfied by a padlock having a lock body defining first and second passages therein;

a shackle having first and second shanks linearly displaceable in the first and second passages between a locked position and a released position, the first shank being withdrawn from the first passage and the second shank being retained in the second passage in the released position;

a housing having a lock body reception space and a head space;

the housing comprising a reception groove at an outside thereof extending along the head space adjoining the first passage;

and the first shank at least partly overlapping the housing and being pivotable into and out of the reception groove about the second shank in the released position.

Such a padlock has a modular design which allows not only to exchange the lock body (including the locking mechanism) if necessary, but also the housing. Particularly, instead of a standard size housing of relatively short length a long housing may be used which for example has bilingual warning messages printed on its exterior. The padlock can be easily and quickly assembled from an existing padlock having a standard size housing and shackle by exchanging the housing and shackle, while optionally keeping the lock body if desired. As such, if a customer requires a padlock (particularly a lockout lock) having a relatively long housing, a locksmith or a service unit may simply provide an off-the-shelf or existing standard lock body with the housing according to the invention and an associated shackle. The padlock according to the invention and particularly its housing therefore in conjunction with standard size padlocks create a modular padlock system which allows an easy and fast modification of the padlock exterior design.

The housing including the reception groove can be manufactured very cheaply, particularly when the housing is made of plastic. For example, the housing can be made in an injection molding process. The associated shackle must be of corresponding length but can be of simple design. If an electrical insulation is desired for the use as a lockout lock, the shackle can be made of plastic, or the shackle can be made of a metal or a metal alloy having a plastic cover on the parts protruding from the housing during use.

As such, the invention minimizes the inventory investment and at the same time facilitates faster delivery of desired padlock configurations.

Moreover, by providing the housing with said reception groove a padlock is created which can only be opened by pivoting the padlock about the second shank in one direction. This also prevents the padlock from unnecessarily engaging plant parts when the lock is opened, since it cannot open about a full angle of 360° as is the case for prior art padlocks.

The padlock in accordance with the invention will be explained in the following only by way of example with reference to the drawings and by means of the dependent claims.

The invention further relates to a set of padlocks which comprise a first padlock, which is of prior art design, i.e. having a relatively short housing without a reception groove, and a second padlock having the herein described features.

The invention further relates to a padlock housing comprising:

- a lock body reception space for receiving a lock body and a head space; and
- a reception groove at an outside of the housing extending along the head space for receiving a shank of a shackle of the padlock.

The invention further relates to a method of retrofitting a padlock, the padlock comprising a lock body defining first and second passages therein, a first shackle having first and second shanks linearly displaceable in the first and second passages between a locked position and a released position, and a first housing having a lock body reception space. The method comprises the steps of:

- removing the first housing and the first shackle from the lock body; and
- mounting a second shackle and a second housing to the lock body;

wherein the second shackle is longer than the first shackle along an axis of the first passage; and wherein the second housing is longer than the first housing along the axis of the first passage, the second housing comprising a lock body reception space for receiving the lock body and a head space, and further comprising a reception groove at an outside of the second housing, wherein the reception groove extends along the head space and adjoins the first passage of the lock body.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
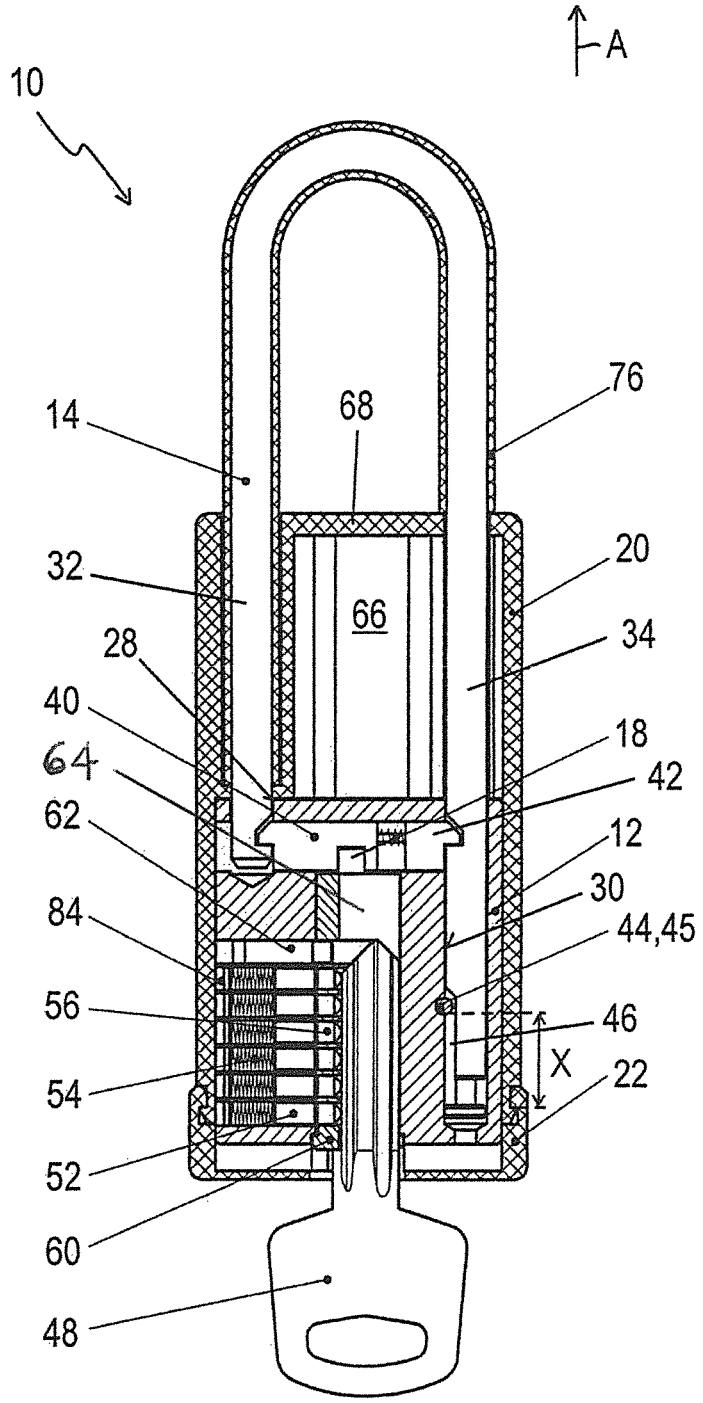
FIG. 1 is a cross-sectional view through the center of a padlock from the front in accordance with the invention.

The following description is merely exemplary in nature and is not intended to limit the present disclosure, application, or uses. It should be understood that throughout the drawings, corresponding reference numerals indicate like or corresponding parts and features.

Referring now to FIG. 1, where a section through a padlock 10 is illustrated. The padlock comprises a lock body 12, a U-shaped shackle 14 and a lock actuator 18 that are secured within the lock body 12. The lock body 12 is incorporated in a housing 20 and terminated at an end (bottom side) by a plastic bumper 22 of the housing 20. The lock body 12 further defines first and second passages 28, 30, within which respective first and second shanks 32, 34 of the shackle 14 are slidably disposed.

The first and second shanks 32, 34 include respective notches, which are selectively engaged by respective locking members 40, 42 or bolt drivers of the lock actuator 18 to inhibit axial movement of the shackle 14 in the direction A when the lock is locked. The first shank 32 is shorter than the second shank 34 and may be withdrawn from the first passage 28. The second shank 34 is slidably disposed within the second passage 30 but can not be withdrawn therefrom. More specifically, a shackle retaining pin 44 of the lock body 12 extends into a blocking notch 46 defined within the second shank 34. The blocking notch 46 defines the range of slidable movement of the second shank 34 within the second passage 30. The shackle retaining pin 44 inhibits a removal of the second shank 34 from the second passage 30.

A rotatable plug 60 secured with a plug retaining pin 62 is operably engaged with the lock actuator 18. The plug retaining pin 62 also serves as a rotational abutment for the plug 60, i.e. a so-called stop pin. A key 48 is insertable into a keyhole of the plug 60 to enable rotation of the plug 60 between a first position and a second position. In the first position, which is shown in FIG. 1, the plug 60 holds the lock actuator 18 in a locked condition. In the locked condition, the locking members 40, 42 of the lock actuator 18 engage the notches of the first and second shanks 32, 34 of the shackle 14, thereby inhibiting axial movement of the shackle 14 in the direction A. In the second position, the plug 60 holds the lock actuator 18 in an unlocked condition (not shown). In the unlocked condition, the locking members 40, 42 of the lock actuator 18 retreat from the notches of the first and second shanks 32, 34, enabling the shackle 14 to move in the direction A (and vice versa) by a distance X defined by the shackle retaining pin 44 and the blocking notch 46 of the second shank 34. During the assembly of the padlock 10 the retaining pin 44 is only introduced into the lock body 12 in a loose manner as will be discussed in the following.

When the key 48 is turned to open the lock (not shown) it actuates the lock actuator 18. A series of cylindrical pins 52 respectively biased with respect to a pin hole cover 84 via pin springs 54 permit the movement of the plug 60 via the key 48 only if bottom pins 56 align the cylindrical pins 52 at a shear line permitting movement of the plug 60 and hence of the lock actuator 18.

As can be seen from FIG. 1 the housing 20 is of generally rectangular shape and is preferably made of plastic, as this is an electrically insulating and light weight durable material, which can be provided in a multitude of colors in a simple injection molding process. The different colors enable a color coding between different locks 10 and machine parts or operating/servicing personal (not shown).

In addition to housing the lock body 12 in a lock body reception space 64, the housing 20 further comprises a head space 66 at its end 68 housing the second shank 34 of the shackle 14. This means that a volume of the housing 20 between the lock body 12 and the end 68 (i.e. the top side) of the housing 20 is referred to herein as the head space 66. For this purpose second shank 34 is guided within the head space 66 between the second passage 30 and the end 68. The first shank 32 is guided in a reception groove 72 (FIG. 2) arranged at an outside of the housing 20 in the region of the head space 66 adjoining the first passage 28. In particular, the reception groove 72 is arranged at a corner of the housing 20. The reception groove 72 extends coaxially with the first passage 28 and is parallel to the second passage 30 of the lock body 12.

In the unlocked state of the padlock 10, i.e. when the locking members 40, 42 are retracted from the notches, the shackle 14 is slid upwardly (with respect to the drawing, it can naturally also slide in any direction A in which the padlock 10 is pointing in use) whilst the second shank 34 is retained in the housing 20 by means of the shackle retaining pin 44. The distance X the shackle 14 is displaced in the direction A would actually be too small for allowing the pivoting of the first shank 32 about the second shank 34 since the first shank 32 still partly overlaps the housing 20 and the first shank 32 would thus still be stuck within the housing 20. Accordingly, if the reception groove 72 were not provided, the padlock 10 would not function.

The shackle 14 and the lock body 12 are generally of metal or a metal alloy. For example, the lock body 12 can be formed by aluminum or an aluminum alloy to save weight. As can be seen from FIG. 1 the shackle 14 is at least partly covered with a plastic casing 76 at least in an external region of the padlock 10, i.e. those parts of the shackle which in the locked state of the padlock are visible. The plastic casing 76 is provided to additionally electrically insulate the shackle 14.

The housing 20 has a length which is at least substantially defined by the sum of a length of the lock body reception space 64 and a length of the reception groove 72. In practice one would normally select the length of the reception groove 72 to correspond to at least 20% of a length of the housing 20 and to at most 80% of a length of the housing 20. Other lengths are naturally possible, provided at least a part of the first shank 32 is still received by the reception groove 72 in the released state. In the example of FIG. 1 length of the reception groove 72 corresponds at least substantially to the length of the lock body reception space 64.

A shank 32, 34 is herein defined as a limb of the shackle 14, the length of the shank 32, 34 being defined as the dimension extending from a free end of the shank to the start of the curvature of the shackle 14.

Figure 2:
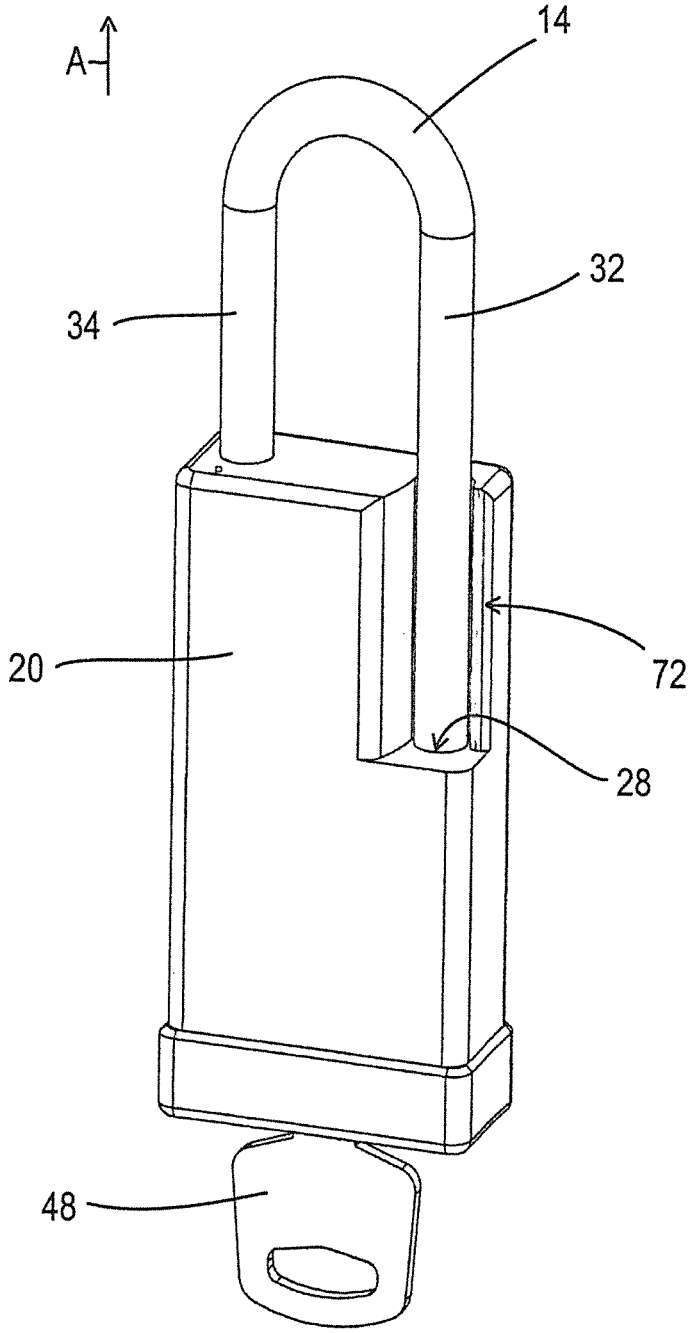
FIG. 2 is a perspective rear view of the padlock.

FIG. 2 shows a perspective rear view of the padlock 10 with an installed shackle 14 in the locked position. One can clearly see the reception groove 72 into and out of which the first shank 32 of the shackle 14 is pivoted in use in the released state of the padlock 10, and which also allows a rectilinear movement of the first shank 32 of the shackle 14 along the direction A for inserting the first shank 32 into the first passage 28 of the lock body or for withdrawing the first shank 32 of the shackle 14 from the first passage 28.

It also becomes clear from FIG. 2 that the front side of the housing 20 (hidden in FIG. 2) has a large surface not affected by the reception groove 72. The large surface of the front side of the housing 20 offers enough space, for example, to print warning messages on the padlock 10 in multiple languages or to apply an identity photograph.

Figure 3:
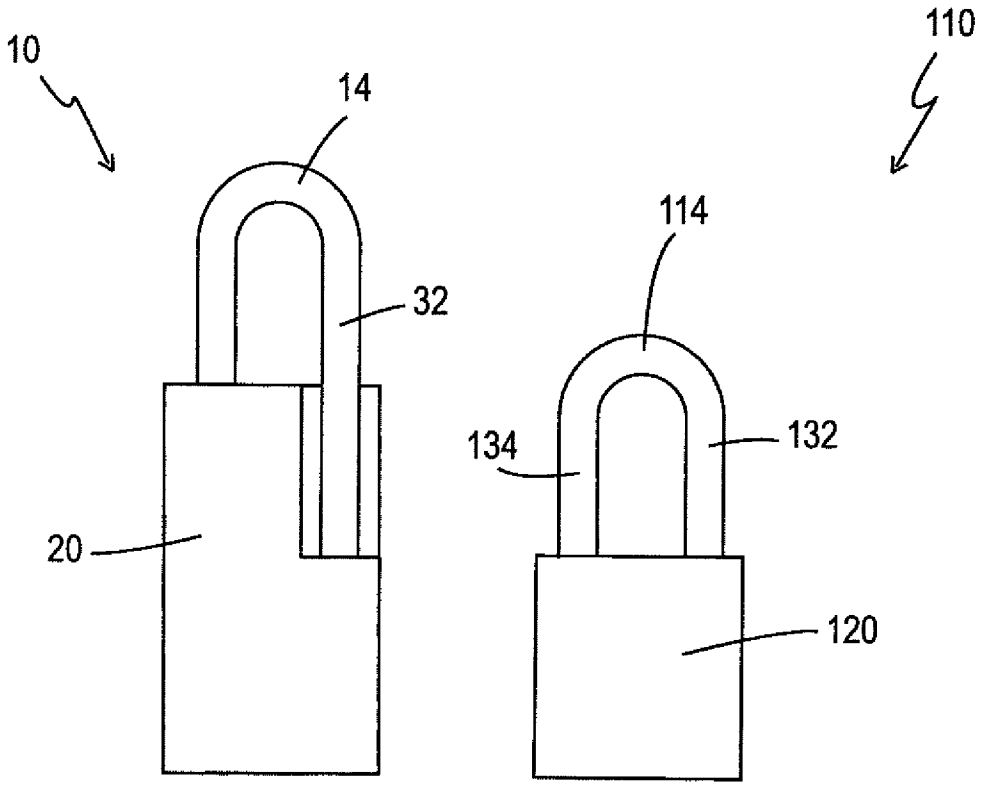
FIG. 3 shows a set of padlocks comprising a padlock in accordance with FIG. 1 and a padlock having an identical interior and the same shackle engagement length (clearance) but a smaller sized standard housing.

The invention also relates to a set of padlocks (FIG. 3) comprising at least: a first padlock 110 and a second padlock 10 as herein described, the first padlock 110 including the same lock body as the second padlock 10, but a smaller sized regular housing 120 and also a shorter shackle 114 (having first and second shanks 132, 134). In general, the set can include multiple padlocks having a variety of housing lengths and associated reception groove lengths and shackle lengths. Since the plastic housing 20 can be manufactured very cheaply and since also the manufacture of the shackle 14 does not require great expense, the set of padlocks according to FIG. 3 can be provided based on the same type of internal lock body at low additional costs. As shown in FIG. 3, both padlocks 10 and 110 have the same engagement length or clearance of their respective shackles 14 and 114 when the padlocks 10 and 110 are locked.

If a customer requires a lockout lock having a long housing 20 (for example having warning messages in multiple languages printed on the housing 20), it is possible to retroactively convert a standard size first padlock 110 according to FIG. 3 to a so-called "long-body" type second padlock 10 by simply exchanging only the housings 120, 20 and shackles 114, 14. Such a method of retrofitting a padlock includes the steps of: removing the housing 120 and the shackle 114 of the first padlock 110 from its lock body; and mounting instead the second shackle 14 and the second housing 20 to the lock body.

More particularly, the step of mounting the shackle 14 and the housing 20 to the lock body may generally comprise: inserting the second shank 34 of the shackle 14 into the second passage 30 of the lock body 12 (see FIG. 1); retaining the second shank 34 in the second passage 30; and subsequently encasing the lock body 12 by means of the housing 20.

For example, the second shank 34 is introduced into the lock body 12 of the padlock 10 via the second passage 30 until the second shank 34 of the shackle 14 abuts at an end of the second passage 30 (see FIG. 1). Once the second shank 34 abuts the end of the second passage 30 the retaining pin 44 is introduced substantially perpendicular to the second shank 34 into a bore 45, i.e. the shackle retaining pin 44 and the bore 45 are oriented in a transverse direction with respect to an axis of the second shank 34 of the shackle 14. In this way the shackle 14 is retained in the second passage 30 and can only move in the direction A by the distance X. The retaining pin 44 is only introduced into the bore 45 in a loose manner, such that the retaining pin 44 can be removed again if necessary and the housing 20 and/or the shackle 14 can be exchanged without the need of a tool. During the assembly the housing 20 can already be positioned partly over the lock body 12 such that the bore 45 is still accessible and the second shank 34 can be introduced into the lock body 12. Once the retaining pin 44 has been introduced into the lock body 12, the housing 20 is slid further over the lock body 12 and the plastic bumper 22 is placed over the end of the housing 20 (for example forming a snap-fit) in order to secure the housing 20 to the padlock 10.

What is claimed is:

1. A padlock comprising a lock body defining first and second passages therein;

a shackle having first and second shanks linearly displaceable in the first and second passages between a locked position and a released position, the first shank being withdrawn from the first passage and the second shank being retained in the second passage in the released position;

a housing having an internal volume, the internal volume having a lock body reception space and a head space;

the housing comprising a reception groove at an outside thereof extending along the head space adjoining the first passage;

and the first shank at least partly overlapping the housing and being pivotable into and out of the reception groove about the second shank in the released position, wherein the housing encases the second shank between a top side of the housing and the lock body reception space.

2. The padlock according to claim 1, wherein the housing has a length which is at least substantially defined by the sum of a length of the lock body reception space and a length of the reception groove.

3. The padlock according to claim 1, wherein a length of the reception groove corresponds to at least one of at least 20% of a length of the housing and at most 80% of a length of the housing.

4. The padlock according to claim 1, wherein a length of the reception groove corresponds at least substantially to a length of the lock body reception space.

5. The padlock according to claim 1, wherein the housing is of at least substantially rectangular shape.

6. The padlock according to claim 1, wherein the reception groove is provided at a corner of the housing.

7. The padlock according to claim 1, further comprising locking means which simultaneously engage the first and the second shank in the locked position.

8. The padlock according to claim 7, wherein the locking means engage the first and second shank at respective engagement portions of the first and second shank, the engagement portions of the respective shanks facing one another.

9. The padlock according to claim 1, further comprising a retaining means for retaining the second shank in the lock body in the released position.

10. The padlock according to claim 9, the retaining means comprising a shackle retaining pin and a blocking notch.

11. The padlock according to claim 10, wherein an end of the second shank comprises the blocking notch which engages the shackle retaining pin in the released position in order to prevent a further linear displacement of the second shank.

12. The padlock according to claim 1, wherein the housing is made of a plastic.

13. The padlock according to claim 1, wherein the lock body is made of one of a metal and a metal alloy.

14. The padlock according to claim 1, wherein the shackle is made of one of a metal and a metal alloy.

15. The padlock according to claim 1, wherein the shackle is at least partly covered with a plastic casing.

16. A set of padlocks comprising at least: a first padlock and a second padlock according to claim 1, the first padlock including the same type of lock body as the second padlock, a shackle having first and second shanks, and a housing which does not overlap with the first shank of the shackle of the first padlock in the released position.

17. A method of retrofitting a padlock comprising a lock body defining first and second passages therein, a first shackle having first and second shanks linearly displaceable in the first and second passages between a locked position and a released position, and a first housing having an internal volume, the internal volume having a lock body reception space;

the method comprising the steps of:

removing the first housing and the first shackle from the lock body;

mounting a second shackle and a second housing to the lock body;

wherein the second shackle is longer than the first shackle along an axis of the first passage; and wherein the second housing is longer than the first housing along the axis of the first passage, the second housing comprising a lock body reception space for receiving the lock body and a head space, and further comprising a reception groove at an outside of the second housing, wherein the reception groove extends along the head space and adjoins the first passage of the lock body.

18. The method of claim 17, wherein the step of mounting the second shackle and the second housing to the lock body comprises:

inserting a second shank of the second shackle into the second passage of the lock body;

loosely inserting a shackle retaining pin into an opening of the lock body such that the shackle retaining pin engages a blocking notch of the second shank of the second shackle, the shackle retaining pin being oriented transversely with respect to an axis of the second shank of the second shackle; and displacing the second housing over the lock body such that the shackle retaining pin is blocked against removal out of the lock body.

* * * * *